United States Patent [19]

Hunter et al.

[11] Patent Number: 4,537,637

[45] Date of Patent: Aug. 27, 1985

[54] HYDRATION DRYING PROCESS

[75] Inventors: George L. K. Hunter, Atlanta; Daniel B. Dennison, Tucker; Charles E. Stephens, Dunwoody, all of Ga.

[73] Assignee: The Coca-Cola Company, Atlanta, Ga.

[21] Appl. No.: 463,187

[22] Filed: Feb. 2, 1983

Related U.S. Application Data

[63] Continuation-in-part of Ser. No. 179,452, Aug. 19, 1980, abandoned.

[51] Int. Cl.[3] ..... C13F 5/00

[52] U.S. Cl. ..... 127/60; 127/58; 127/DIG. 1; 426/443; 426/455; 426/594; 426/597; 426/599; 426/658

[58] Field of Search ..... 426/443, 590, 594, 597, 426/599, 658, 455; 34/9, 42; 127/29, 34, 42, 46.1, 58, 60, DIG. 1

[56] References Cited

U.S. PATENT DOCUMENTS

| | | | |
|---|---|---|---|
| 1,481,893 | 1/1924 | Fleming | 426/471 |
| 1,902,773 | 3/1963 | Hale . | |
| 2,058,852 | 10/1936 | Bruce | 127/30 |
| 2,147,238 | 2/1939 | Bruce | 426/599 |
| 2,367,131 | 1/1945 | Leo et al. | 426/599 |
| 2,471,678 | 5/1949 | Flosdorf | 99/206 |
| 2,513,813 | 7/1950 | Milleville | 99/205 |
| 2,567,038 | 9/1951 | Stevens et al. | 99/206 |
| 2,826,504 | 3/1958 | Chase et al. | 99/71 |
| 2,906,630 | 9/1959 | Turkot | 99/206 |
| 2,949,401 | 8/1960 | Wershaw | 167/81 |
| 2,970,978 | 2/1961 | Stevens | 195/102 |
| 3,293,133 | 12/1966 | Hill | 167/82 |
| 3,347,682 | 10/1967 | Rosenstein et al. | 99/148 |
| 3,540,927 | 11/1970 | Niimi et al. | 127/30 |
| 3,582,399 | 6/1971 | Black | 127/58 |
| 3,619,294 | 11/1971 | Black et al. | 127/29 X |
| 3,660,115 | 5/1969 | Revie | 99/140 R |
| 3,953,615 | 4/1976 | Gupta et al. | 426/594 |
| 3,975,547 | 8/1976 | D'Ercole | 426/590 X |
| 3,989,852 | 11/1976 | Palmer | 426/590 |
| 4,357,172 | 11/1982 | Edwards | 127/60 |

FOREIGN PATENT DOCUMENTS

| | | | |
|---|---|---|---|
| 499528 | 1/1954 | Canada | 99/53 |
| 716723 | 1/1942 | Fed. Rep. of Germany | 53/1 |
| 508602 | 1/1955 | Italy . | |
| 34966 | 1/1966 | Japan . | |
| 781466 | 4/1966 | Japan . | |
| 2510969 | 10/1969 | Japan . | |
| 2093370 | 7/1970 | Japan . | |

OTHER PUBLICATIONS

Lachmann, Alfred, Agglomeration Forms 'New' Sugars, Food Engineering, May 1966, pp. 140–145.

Cruess et al., *Canner* 102, No. 16, 12 (1946).

*Primary Examiner*—Richard V. Fisher

*Assistant Examiner*—W. Gary Jones

*Attorney, Agent, or Firm*—William C. Lee, III; Eduardo M. Carreras

[57] ABSTRACT

A process for hydration drying a solids containing aqueous product is disclosed in which particulate anhydrous alpha-dextrose is violently agitated with the aqueous product for a predetermined short period of time, with the temperature agitated product maintained at or below 50° C. Specifically a process to be carried out at room temperature is disclosed in which the temperature of the agitated products is maintained at or below 50° C. by allowing the agitated products to remain quiescent for some period after violent agitation to dissipate the heat of hydration and the heat generated by friction during agitation.

12 Claims, No Drawings

HYDRATION DRYING PROCESS

This is a continuation in part of application Ser. No. 179,452, filed on Aug. 19, 1980, now abandoned.

BACKGROUND OF INVENTION

The present invention relates generally to a process for the substantially non-dehydration drying of solids-containing aqueous systems, and particularly to the use of such a process in the preparation of free-flowing, non-hygroscopic powders from such aqueous systems.

The prior art is replete with discussions of the problems inherent in dealing with products produced and utilized in association with any significant degree of liquid. Thus, for example, solids-containing aqueous systems such as milk, natural fruit and vegetable juices, soft drinks, sauces, puddings, extracts of coffee and tea, and the like present numerous difficulties to manufacturers, distributors and consumers in the packaging, handling, shipping, and storage requirements imposed by virtue of the water content of these products.

In response to these problems, the prior art has proposed a variety of methods to accomplish the partial or substantially complete removal of water from such products and thereby produce reduced volume products, ideally substantially water-free, flowable powders, which may be reconstituted, upon addition of water, to the dilution desired for ultimate use. Conventional processes for accomplishing this dehydration of solidscontaining aqueous systems. are based upon the removal of water in its vapor state, for example, by its evaporation from a liquid system or its sublimation from a frozen system.

Although the removal of water from aqueous systems according to conventional processes presents in the abstract few, if any, technical problems, it has long been recognized that the conditions under which such removal of water is accomplished may deleteriously affect the product such that, upon reconstitution, the product is degraded or otherwise dissimilar as compared to the starting product. Thus, for example, while heating a solids-containing aqueous product to boiling is an effective means of removing water per se, the prolonged heating may substantially alter the product in an undesirable manner.

The foregoing problem is particularly attenuated where the product being dehydrated is a foodstuff having desirably retained organoleptic properties, such as flavor, color, aroma, mouthfeel, texture or appearance. To take but one example, dehydration of natural fruit juices, such as orange juice, has been practiced by spray drying, vacuum shelf or belt drying, drum drying, foam-mat drying and freeze drying. These processes generally involve the concentration of juice followed by the dehydration of the concentrate through the application of heat and/or vacuum under controlled conditions. Many difficulties have been encountered in such processes, particularly those processes yielding dry, solid products, and heretofore there has been developed no practical and economical process for the production of free-flowing juice powders that can be readily reconstituted by the addition of water to yield a product closely resembling a fresh juice beverage in quality, flavor and appearance.

Spray drying is not satisfactory in many cases because the dried product is usually found to be inferior to the original juice concentrate in flavor and stability. Such products are extremely hygroscopic, due to the natural hygroscopicity of juice solids. In many cases, it is difficult to spray dry the juices without the addition of large amounts of carriers. If used, these carriers can impart an undesirable taste to the product and are generally unacceptable at the concentration levels that are required for satisfactory spray drying.

Vacuum shelf or belt drying also imparts a cooked flavor to the dried product and frequently causes browning of the product. This results in an undesirable taste and detracts from visual acceptance. Moreover, because of the high vacuum conditions of these drying processes, desirable volatiles are lost through vaporization.

In drum drying, the sugar present in the juice prevents the formation of a sheet which can be easily removed by the dryer's doctor blade or scraper. Instead of being able to remove a continuous dried sheet from the dryer, the dried juice yields a gummy mass after heating which collects at the doctor blade and disrupts the drying operation. This process also imparts an undesirable off-flavor to the product.

Foam-mat drying involves the use of a foaming agent in the juice during drying. This foaming agent causes formation of extremely small, microscopic bubbles and produces a larger surface for rapid and more complete drying of the juice powders. However, this process is unsatisfactory since the powders produced often contain incorporated microscopic air bubbles which can promote browning and thus may be detrimental to the flavor and stability of the powder. In addition, "air sols" or colloidal dispersions of these air bubbles are formed throughout the solution upon reconstitution of the dried product. These bubbles impart to the reconstituted juice an unnatural, white, cloudy or milky appearance. After the reconstituted product stands a very short time, the "air sols" rise and collect on the surface as a dense layer of foam. The presence of this milky appearance and particularly the presence of the foam are detrimental to the physical appearance of the products and adversely affect their commercial acceptance.

Freeze drying in general produces the most acceptable product of conventional drying processes. However, the slow rate of sublimation from the frozen state and the high vacuum associated with the process result in loss of desirable volatiles through vaporization and make the process relatively expensive. Also, the dried product produced is hygroscopic and this adversely affects the storage stability and spoonability of the dried product.

U.S. Pat. No. 3,619,294 (Black) discloses a method of drying in which the liquid to be dried is absorbed by granules having an internal capillary network. After the granules are impregnated, the granules are dried in ordinary drying equipment for granular materials, such as a gas fired rotary dryer. One big disadvantage of that system is that it requires the spraying of the liquid onto a bed of granules, and the rate of spraying must be controlled to prevent agglomeration. Thus successive impregnation cycles are required. After each impregnation cycle the granules are usually dried by the application of heat.

A significant improvement in the art of preparing free-flowing, non-hygroscopic food and/or average powders is described in U.S. Pat. No. 3,953,615 to Gupta and Shillinglaw. According to the "hydration drying" method described in that patent, juice concentrate, coffee extracts or tea extracts are admixed with a suitable amount of anhydrous dextrose such that most of the water present in the concentrate is converted into a "bound" form, i.e., by formation, with the anhydrous dextrose, of dextrose monohydrate. In this manner, the Gupta, et al. patent teaches that the water present in the concentrate is no longer readily available for wetting or subsequent interaction with other particles, and the concentrate is reduced to a free-flowing, non-hygroscopic powder. The Gupta, et al patent further teaches that the rate at which this drying, i.e., hydration of the dextrose, takes place can be expedited by subjecting the concentrate/anhydrous dextrose mixture to temperatures in the range of 35° C. to 85° C. By virtue of the fact that the concentrate is not subjected to harsh water removal conditions, products prepared by reconstitution of the powders in water are stated to closely resemble those prepared from the starting concentrate.

The Gupta, et al. patent thus describes a useful method for reducing tea, coffee and juice concentrates to free-flowing, non-hygroscopic powders, and is useful in preparing products compatible with the sweetness and bulking imparted by the overt addition of anhydrous dextrose. We have found, however, that additional refinements in this method result in significant improvement in both the rate of moisture equilibration (and, hence, drying) and the quality of the products produced. Specifically, Gupta and Shillinglaw specify a temperature range which has been found to be disadvantageous. For example, if temperatures over 50° C. are encountered the hydration drying process is adversely affected. Additionally, the Gupta et al. reference is directed to a process that utilizes low agitating speeds. Applicant has found that violent agitation is significantly more efficient so long as temperatures are maintained at or below 50° C.

U.S. Pat. No. 2,147,238 (Bruce) discloses a process for reducing fruit juices to a solid state. The process described entails dissolving dextrose hydrate in a fruit juice and heating the solution to between 120° to 150° Fahrenheit. The solution is then cooled and seeded with dry dextrose. The Bruce reference fails to differentiate between the alpha and beta anomeric conformation ring structure of dextrose. The use of anhydrous beta dextrose has been found to reduce the hydration drying capacity of the method of the present invention.

Other patents in the art of drying liquids include U.S. Pat. Nos. 3,975,547 (D'Ercole): 1,481,893 (Fleming); 2,367,131 (Leo); 3,989,852 (Palmer); 2,826,504; 2,567,038 (Stevens); 2,513,813 (Milleville); 2,906,630 (Turkot); 2,970,978 (Stevens); and 2,471,678 (Flosdorf).

There are also a number of foreign patents relating in general to the art of drying, these are Japanese Patent application Publication Nos. 7814/66; 25109/69; 20933/70; 349/66; Netherland Pat. No. 277729; and German Pat. No. 716723.

SUMMARY OF THE INVENTION

The present invention provides a process for the substantially non-dehydration drying of solids-containing aqueous products based upon the utilization of water present in the product to hydrate added particulate anhydrous alpha-dextrose. By "substantially non-dehydration drying" is meant that the process of the present invention does not rely upon or involve the actual removal of water from the aqueous product to any substantial degree, although a small degree of such removal may occur as an incident to the conditions at which the process is conducted. Rather, substantially all the water present in the starting aqueous product remains in the eventual product in association with the alpha-dextrose as the hydrated alpha-dextrose, i.e., alpha-dextrose monohydrate. The ultimate product of the present invention is a reconstitutable powder wherein a sufficient quantity of the water present in the original aqueous product is caused to be present in the form of alpha-dextrose monohydrate so as to render the powder free-flowing and non-hygroscopic. More specifically, the product of the present invention is a dry, free flowing non-hygroscopic powder.

According to particular features of this invention, the particulate anhydrous alpha-dextrose itself is initially provided for use in the process, i.e., before its admixture with the solids-containing aqueous product, with a degree of moisture of at least about 0.1% by weight and, typically, no more than about 1.0% by weight, as a means for increasing the rate of hydration thereof, once mixed with the aqueous product alpha-dextrose admixture at or below 50° C. as a means for enhancing the formation of alpha-dextrose monohydrate and improving the quality of the ultimate product produced upon reconstitution of the dried product.

As utilized in the description of this invention, "solids-containing aqueous products" is broadly intended to define any aqueous-based system containing recoverable solids, such as a solution, suspension or dispersion, including systems wherein more than one such phase is present. As earlier noted, aqueous systems to which the present invention is particularly directed are foodstuffs, since these products are more susceptible to deleterious alteration as a result of conventional processing. In addition, food products offer a wide adaptability in their ultimate use so as not to be disadvantaged by the sweetening and bulking contributed by the alpha-dextrose utilized in the present invention. Although food products to which the present invention is applicable typically are those intended as final, consumable products, for example, orange or other fruit or vegetable juices, coffee extracts and tea extracts, the present process is also applicable to the non-dehydration drying of products utilized as additives in food processing, for example, aqueous flavorants, spices, acids, herbs and the like.

Additionally, there are no theoretical limits per se on the amount of water which can be present in the starting aqueous product. As will be appreciated, however, practical constraints may exist. Thus, for example, the ability to prepare a free-flowing, non-hygroscopic powder requires that substantially all the water present in the starting aqueous product be utilized in the hydration of the added anhydrous alpha-dextrose, this, in turn, requiring the addition, from stoichiometric principles, of at least one mole of anhydrous alpha-dextrose for each mole of water sought to be so utilized. As such, where extremely dilute solids-containing aqueous products are employed, the amount of anhydrous alpha-dextrose required for addition may be so great as to be not only impractical but also disadvantageous from a sweetening or bulking point of view. Accordingly, it is generally preferred to utilize aqueous products which, either naturally or by virtue of concentration, contain no more than about 80% water by weight, preferably no more than 60% by weight. However, it is obvious that these constraints may vary significantly depending upon the degree of sweetness and bulk which the end product, either alone or in admixture with other components, can tolerate.

DETAILED DESCRIPTION OF THE INVENTION

The present invention derives its utility and advantages from a number of features which are described in further detail hereinafter with the aid of illustrative examples.

Dextrose, the commercial name for D-glucose, is a six-carbon reducing sugar represented by the formula:

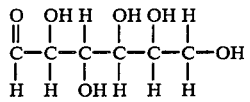

Dextrose will crystallize from concentrate aqueous solution in either of the following anomeric conformational ring structures depending upon the conditions employed:

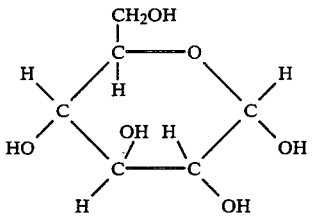

Alpha-Dextrose

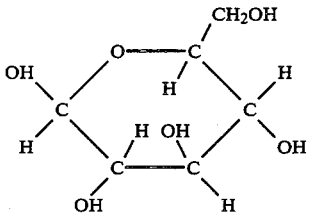

Beta-Dextrose

Anhydrous alpha-dextrose crystallizes from concentrated aqueous solutions at temperatures above 50° C.; anhydrous beta-dextrose crystallizes at temperatures above about 120° C. and alpha-dextrose monohydrate crystallizes from water solutions at temperatures of 50° C. and below.

An important consideration with respect to the present invention is the recognition and utilization of the fact that the dextrose monohydrate exists only in the alpha-anomeric form. Accordingly, anhydrous beta-dextrose will be ineffective in providing a vehicle for utilizing the water in an aqueous product for hydration (and thereby "drying" the product) unless first converted to the anhydrous alpha-anomeric form, an obviously impractical and time-consuming process. Thus, the drying capacity of anhydrous dextrose will be reduced to the extent that beta-dextrose is present and, accordingly, a preferred application of the present invention is the addition to the aqueous solids-containing product of dextrose in its alpha-anomeric form, i.e., containing little or no beta-dextrose.

Additionally, the process of this invention requires that temperatures throughout processing be maintained at or below 50° C. in order to promote the formation of alpha-dextrose monohydrate. Conditions in which temperatures exceed 50° C. are disadvantageous since they favor the formation of anhydrous alpha-dextrose, thus inhibiting the rate of the more desirable "hydration drying" achieved when the water present in the aqueous product, rather than being removed, is used to form alpha-dextrose monohydrate.

In maintaining the anhydrous alpha-dextrose/aqueous product mixture at or below 50° C. until hydration drying is completed, care must be taken that the means employed for achieving the required intimate and uniform mixing of concentrate or extract and dextrose be such that temperatures above 50° C. are not inadvertently encountered as a result of friction or the heat of hydration. In general, it has been found that the most effective means for ensuring this condition comprises blending the materials with intermittent, brief periods of substantially violent agitation as opposed to continuous mixing at violent conditions (causing high heat build-up) or gentle continuous or discontinuous mixing (resulting in incomplete distribution of components).

An additional feature of the present invention resides in the requirement that the anhydrous alpha-dextrose admixed with the aqueous product itself contain a small amount of moisture. When utilized in this manner, it is found that the rate of drying, i.e., the rate at which water present in the product hydrates the anhydrous alpha-dextrose to form alpha-dextrose monohydrate, can be substantially increased as compared to a process utilizing essentially dry anhydrous alpha-dextrose. It is theorized that the provision of a small amount of water in the alpha-dextrose leads to the formation therein of trace quantities of alpha-dextrose monohydrate which act as seed crystals for enhancing the formation of alpha-dextrose monohydrate upon admixture with the aqueous product.

It is further theorized that upon admixture of the anhydrous alpha-dextrose and aqueous product, the anhydrous alpha-dextrose dissolves and subsequently re-crystallizes as alpha-dextrose monohydrate if the conditions for crystallization of this form are maintained, i.e., the presence of alpha-dextrose monohydrate seed crystals and a temperature at or below 50° C.

Typically, the degree of moisture associated with the anhydrous alpha-dextrose starting material is at least about 0.1% by weight and preferably at least about 0.3% by weight in order to ensure the pie-formation of at least some alpha-dextrose monohydrated seed crystals. Although increasing degrees of moisture provide additional monohydrate product for seeding, pre-conversion of too large a quantity of the starting anhydrous alpha-dextrose to the alpha-monohydrate may result in the presence of an insufficient amount of anhydrous alpha-dextrose to be hydrated by the water present in the aqueous product, and, hence, reduced drying capacity of the alpha-dextrose. Accordingly, a practical upper limit on the amount of moisture present in the starting anhydrous alpha-dextrose is about 1.0% by weight, preferably about 0.3% by weight.

In an alternative embodiment of this invention, the desired presence of alpha-dextrose monohydrate seed crystals at the commencement of the hydration drying process can be achieved by the addition of alpha-dextrose monohydrate along with the anhydrous alpha-dextrose (for example, as a pre-blended mixture with anhydrous alpha-dextrose). In this manner, anhydrous alpha-dextrose having a moisture content below 0.1% by weight can also be utilized as a starting material in the process. The amount of added alpha-dextrose monohydrate is typically in the range of from about 1 to about 10 percent by weight of the anhydrous alpha-dextrose, and preferably from about 2 to about 5 percent.

According to one embodiment of the present invention, therefore, there is provided a process for preparing a free-flowing, non-hygroscopic, reconstitutable powder from a solids-containing aqueous product wherein the aqueous product is admixed with particulate anhydrous alpha-dextrose, having a moisture content in the range of from about 0.1% to about 1.0% by weight, in an amount such that a sufficient quantity of water from the product is utilized in the hydration of the alpha-dextrose to render the resultant product a free-flowing, non-hygroscopic, reconstitutable powder, and wherein the temperature to which the admixture is subjected is no greater than 50° C. until the desired hydration is completed.

As will be apparent to those of skill in this art, operation of the process of the present invention may vary among different solids-containing aqueous product. For example, in all cases, the amount of moisture-containing anhydrous alpha-dextrose admixed with the aqueous product will be such, as determined from stoichiometric considerations and experience, as to provide sufficient material for hydration by that quantity of water from the product which must be so utilized in order to provide the desired free-flowing, non-hygroscopic powder. However, the maximum degree of water not so utilized which can be still tolerated in a final, free-flowing non-hygroscopic powdered product will vary among starting products, for example, from among coffee and tea extracts, which can tolerate in powder form up to 8% (by weight) free, i.e., non-utilized, moisture and citrus juice extracts which can tolerate only about 5% by weight of such moisture. As a result, the amount of anhydrous alpha-dextrose needed to prepare powdered products from these starting materials, assuming equal starting water content, can similarly vary.

In addition, it will be found that aqueous products containing sugar generally required longer periods of time to accomplish the hydration drying of the present invention as compared to products, for example, coffee, tea and caramel extracts, spices and acids which contain little or no sugar, possibly due to the hygroscopicity imparted by the sugar.

The anhydrous alpha-dextrose, (and, if utilized, any alpha-dextrose monohydrate) utilized in the process of this invention is itself in particulate or subdivided form. Although there are no known limitations on the particle size of the alpha-dextrose vis-a-vis its ability to bring about hydration drying, it is noted that the rate of hydration appears to increase as the particle size of the alpha-dextrose is reduced. Typically, the particle size of the anhydrous alpha-dextrose will be such that about 97% will pass through a 20 mesh screen.

The powdered products prepared according to this invention may be reconstituted in liquid to an appropriate dilution to directly prepare a liquid-based product such as a food or beverage. In addition, the powdered products may be advantageously utilized in preparing reconstitutable compositions containing other dry ingredients. In this latter usage, it is possible to pre-formulate such a composition, or portions thereof, by adding suitable dry or liquid-containing ingredients to the primary solids-containing aqueous product and then admixing this composition with a suitable amount of anhydrous alpha-dextrose to effect the desired degree of hydration drying thereof, or, alternatively, premixing such ingredients with the alpha-dextrose for admixture with the aqueous product.

EXAMPLE 1

Example 1 was performed at room temperature.

Forty-four (44) Kg of anhydrous alpha-dextrose having a moisture content of 0.3% by weight were blended with 178 Kg of sugar and 1.65 Kg of citric acid. To this mixture was rapidly added, with violent agitation for 30 seconds using a Model T-25 Turbulent Blender (Day Mixing Co.), 2.5 Kg of 70° Brix caramel. After 15 minutes, agitation was repeated for 10 seconds. The dried product (moisture content 0.4% by weight) was removed from the blender and screened to dissipate any residual heat and provide a product of uniform particle size. The powder was packaged and retained its free-flowing character during ambient storage conditions.

EXAMPLE II

Example 2 was performed at room temperature.

165 Kg. of anydrous alpha-dextrose having a moisture content of 0.25% were added to a Model T-25 Turbulent Blender (Day Mixing Co.). 26 Kg. of lemon concentrate (31.24% total acidity) pre-blended with color and flavor were admixed in three equal increments at 15 minute intervals. Each increment was added, and violently agitated, for 15 seconds. Immediately after the addition of the final increment of lemon concentrate, 32.5 Kg. of sugar were added and violently agitated for 15 seconds to insure complete and uniform distribution of ingredients. At 15 minute intervals the product was agitated for 10 seconds for the next hour during the moisture equilibration phase. The dried product (moisture content 6.5%) was removed from the blender and screened to dissipate any residual heat and provide a product of uniform particle size. If necessary, the particle size could be reduced by milling. The resultant powder was packaged and retained its free-flowing character during ambient storage conditions.

EXAMPLE III

Example III was performed at room temperature.

270 Kg. of anhydrous alpha-dextrose having a moisture content of 0.3% were added to a Model T-25 Turbulent Blender (Day Mixing Co.). 42.5 Kg. of 65° Brix orange concentrate were admixed in three equal increments at 30–45 minute intervals. Following the rapid addition of each increment, the contents were violently agitated, for 15 seconds. Immediately after the addition of the final increment, color, flavors and acid were added and violently agitated for 15 seconds to insure complete and uniform distribution of ingredients. The product was agitated for 10 seconds at 15 minute intervals during the moisture equilibration phase. The dried product was removed from the blender and screened to dissipate any residual heat and provide a final product of uniform particle size. If necessary, the particle size could be reduced by milling. The resultant powder was packaged and retained its free-flowing character under ambient storage conditions.

EXAMPLE IV

Example IV was performed at room temperature.

50 g of 17.6 wt. % soluble solids coffee extract, rapidly introduced by spraying, were admixed with 330 g of anhydrous alpha-dextrose (moisture content 0.5%). Color and flavors were added and the product was agitated intermittently for approximately 30 minutes.

The product was then removed, screened and packaged.

EXAMPLE V

Example V was performed at room temperature.

200 g of a 17.6% soluble solids coffee extract, premixed with flavorings and colors, were rapidly admixed with violent agitation with 1.6 Kg of anhydrous alpha-dextrose. The product was agitated intermittently for approximately 45 minutes, removed, screened and packaged. The coffee powder retained its excellent free-flowing characteristics at ambient storage.

EXAMPLE VI

Example VI was performed at room temperature.

380 g of anhydous alpha-dextrose (moisture content <0.1%) were admixed with 20 g alpha-dextrose monohydrate (moisture content 8.6%). Color, flavor and acid were pre-blended with 50° Brix passion fruit juice concentrate. 70 g of passion fruit juice concentrate were admixed in three equal increments, with violent agitation for 15 seconds upon each addition, 15 minutes apart. The product following complete addition, was agitated at 15 minute intervals during the moisture equilibration phase. The dried product was removed from the blender, screened and milled to a uniform particle size and packaged. The resultant powder retained its free-flowing character during storage.

The following examples, together with Example II, serve to illustrate the differing results achieved through the use of anhydrous alpha-dextrose of varying moisture contents.

EXAMPLE VII

Example VII was performed at room temperature.

165 Kg. of anhydrous alpha-dextrose having a moisture content of 0.04% were blended as in Example II with 26 Kg. of lemon concentrate pre-blended with flavor and color. The mixing sequence, intervals and times are as described in Example II. After one hour, the product was slightly sticky and wet, indicating a slow rate of moisture equilibration, even though the moisture content was about 6.2%. An extended period of time (<20 hrs.) was required for moisture equilibration to be achieved such that the final product was a free-flowing powder.

EXAMPLE VIII

Example VIII was performed at room temperature.

183 Kg. of alpha-dextrose monohydrate having a moisture content of approximately 8.5% were blended as in Example II with 26 Kg. of lemon concentrate pre-blended with color and flavor. The mixing sequence, intervals and times are as described in Example VII. After one hour, the product was very sticky and wet. This product, which contained approximately 15% moisture, showed no indication of achieving a dry, free-flowing powder state, even after 48 hours. The following Examples illustrate the varying results achieved through utilization of different modes of agitation.

EXAMPLE IX

Example IX was performed at room temperature.

15 Kg. of anhydrous alpha-dextrose having a moisture content of 0.25% were added to a laboratory model ribbon blender (Day Mixing Co.). 2.3 Kg. of lemon concentrate (31.24% total acidity) pre-blended with color and flavor were admixed in three equal increments at 15 minute intervals with continuous agitation. After one hour, substantial heat developed in the product, the distribution of the concentrate was non-uniform and the product did not yield a dry free-flowing powder.

EXAMPLE X

Example X was performed at room temperature.

15 Kg. of anhydrous alpha-dextrose having a moisture content of 0.25% were added to a laboratory model ribbon blender (Day Mixing Co.). 2.3 Kg. lemon concentrate (31.24% total acidity) pre-blended with color and flavor were admixed in three equal increments at 15 minute intervals with periodic, short duration agitation. After one hour, there was a minimal development of heat, but the distribution of the concentrate was non-uniform and did not yield a dry free-flowing powder.

EXAMPLE XI

Example XI was performed at room temperature.

165 Kg. of anhydrous alpha-dextrose having a moisture content of 0.25% were added to a Model T-25 Turbulent Blender (Day Mixing Co.). 26 Kg. of lemon concentrate (31.24% total acidity) pre-blended with color and flavor were admixed in three equal increments at 15 minute intervals with continuous agitation. After one hour, substantial heat developed in the product due to mixing, the distribution of the concentrate was non-uniform and the product did not yield a dry free-flowing powder.

Surprisingly advantageous results are achieved using the present invention because of not only the temperature employed but also because of the kind of agitation employed as well as the duration of said agitation.

The Table below summarizes the experimental results:

TABLE I

| Example | Degree of Agitation | Duration | Residual Heat | Distribution of Concentrate |
|---|---|---|---|---|
| I to VI | Violent | Intermittent | Minimal | Uniform dry free flowing powder |
| IX | Gentle | Continous | >50° C. | Not uniform did not dry |
| X | Gentle | Intermittent | Minimal | Not uniform did not dry |
| XI | Violent | Continous | >50° C. | Not uniform did not dry |

The type of mixing agitation was found to be critical to the manufacture of an acceptable product. Gentle, continous agitation (Example IX) resulted in the incomplete distribution of concentrate and the tendency to form sugar-concentrate clumps. Continous, violent agitation (Example XI) provided a product that did not dry easily. In both cases, there was substantial heat build-up (50° C.) due to friction and the heat of hydration. This suggests that at temperatures greater than 50° C., the dextrose is solubilized and tends to crystallize as anhydrous dextrose.

The violent intermittent agitation (Examples I to VI) of dextrose was found to be sufficient to provide a uniform, dry, free-flowing powder, with only minimal heat build-up.

As is apparent from the foregoing description, the process of the present invention, in addition to the obvious advantages associated with the provisions of a means for the non-dehydration drying of products at non-deleterious conditions, also is highly advantageous with respect to the speed with which these products may be converted to the desired free-flowing powders and the resultant equipment, manpower and energy savings. The description provided illustrates these and other advantages, but is not to be considered as limiting the conditions, products or means for practicing the invention, the scope of which is defined in the appended claims.

We claim:

1. A process for drying a solids-containing aqueous product comprising the steps of:

adding the aqueous product to a pre-determined quantity of particulate anhydrous alpha-dextrose and aqeous product;

hydrating said particulate anhydrous alpha-dextrose with the aqueous component of the aqueous product by repeatedly agitating the particulate anhydrous alpha-dextrose and the aqueous product in a violent manner, whereby a substantial portion of the anhydrous alpha-dextrose is hydrated to alpha-dextrose monohydrate by the water in the aqueous product; and maintaining the temperature of the hydrating particulate anhydrous alpha-dextrose and aqueous product at or below 50° C. by allowing the anhydrous alpha-dextrose, aqueous product and alpha-dextrose monohydrate to remain quiescent after each agitating step whereby the heat generated by the agitating step is dissipated and the temperature of the alpha-dextrose monohydrate and the remaining anhydrous alpha-dextrose and aqueous product is maintained at or below 50° C.; wherein the hydration reaction is not inhibited by temperatures greater than 50° C. and a dry, free-flowing non-hygroscopic powder results;

conditions are such that temperature would rise above 50° C. in the absence of admixing using intermittent, brief periods of substantially violent agitation; and formation of the dry, free-flowing non-hygroscopic powder is a result of water in the aqueous product forming alpha-dextrose monohydrate.

2. The process of claim 1 wherein the predetermined quantity of anhydrous alpha-dextrose is sufficiently large so that the ratio by weight of anhydrous alpha-dextrose to the water present in the aqueous product is at best 10:1.

3. The process of claim 1 further comprising an initial step of:

selecting particulate anhydrous alpha-dextrose having a moisture content in the range of from about 0.1% to about 0.3% by weight.

4. A process for drying a solids-containing aqueous product comprising the steps of:

adding said aqueous product to particulate anhydrous alpha-dextrose;

agitating said particulate anhydrous alpha-dextrose and aqueous product violently so that at least a portion of said anhydrous alpha-dextrose is hydrated and converted to alpha-dextrose monohydrate;

stopping the agitating before the temperature of the anhydrous alpha-dextrose, aqueous product, or alpha-dextrose monohydrate reaches 50° C.; and dissipating the heat generated by the agitating and the conversion of anhydrous alpha-dextrose to alpha-dextrose monohydrate; wherein the remaining anhydrous alpha-dextrose, aqueous product and alpha-dextrose monohydrate can be violently agitated again and the temperature maintained at or below 50° C.;

conditions are such that temperature would rise above 50° C. in the absence of admixing using intermittent, brief periods of substantially violent agitation; and formation of a dry, free-flowing non-hygroscopic powder is a result of water in the aqueous product forming alpha-dextrose monohydrate.

5. The process of claim 4 further comprising:

repeating the agitating, stopping and dissipating steps until substantially all of the water contained in the aqueous product is hydrated.

6. The process of claim 4 further comprising an initial step of:

selecting particulate anhydrous alpha-dextrose having a moisture content in the range of from about 0.1% to 0.3% by weight.

7. The process of claim 4 further comprising an initial step of:

measuring a quantity of anhydrous alpha-dextrose said quantity being in the ratio of at least 10:1 parts by weight relative to the water present in said aqueous product.

8. The process of claim 4 wherein said solids containing aqueous product comprises a solution of caramel.

9. The process of claim 8 wherein said adding step comprises:

adding rapidly a predetermined amount of a caramel solution to a predetermined amount of anhydrous alpha-dextrose; and wherein said stopping step comprises:

stopping the agitating after approximately 30 seconds; and wherein said dissipating step comprises:

allowing the anhydrous alpha-dextrose, alpha-dextrose monohydrate and caramel solution to remain quiescent for a period of approximately 15 minutes whereby heat produced by the hydration and agitation is dissipated.

10. The process of claim 9 further comprising the step:

agitating violently the alpha-dextrose monohydrate and remaining caramel solution and alpha-dextrose monohydrate for approximately 10 seconds after the quiescent period.

11. A process for drying a solids-containing aqueous product comprising the steps of:

selecting a quantity of particulate anhydrous alpha-dextrose having a moisture content in the range from about 0.1% to about 0.3% by weight;

adding said aqueous product to said particulate anhydrous alpha-dextrose;

hydrating said particulate anhydrous alpha-dextrose with the aqueous component of the aqueous product by repeatedly agitating the particulate anhydrous alpha-dextrose and the aqueous product in a violent manner, whereby a substantial portion of the anhydrous alpha-dextrose is hydrated to a alpha-dextrose monohydrate by the water in the aqueous product; and maintaining the temperature of the hydrating particulate anhydrous alpha-dextrose and aqueous product at or below 50° C. by allowing the anhydrous alpha-dextrose, aqueous product and alpha-dextrose monohydrate to remain quiescent after each agitating step whereby the heat generated by the agitating step is dissipated and the temperature of the alpha-dextrose monohydrate and the remaining anhydrous alpha-dextrose aqueous product is maintained at or below 50° C.; wherein the hydration reaction is not inhibited by temperatures greater than 50° C. and a dry, free-flowing non-hygroscopic powder results;

conditions are such that temperature would rise above 50° C. in the absence of admixing using intermittent, brief periods of substantially violent agitation;

formation of the dry, free-flowing non-hygroscopic powder is a result of water in the aqueous product forming alpha-dextrose monohydrate.

12. The process of claim 11 wherein:

said quantity of anhydrous alpha-dextrose is sufficiently large so that the ratio by weight of anhydrous alpha-dextrose to the water present in the aqueous product is at least 10:1.

* * * * *